US005708991A

United States Patent [19]

DeMarco

[11] Patent Number: 5,708,991

[45] Date of Patent: Jan. 20, 1998

[54] WATER SAVING DEVICE FOR A WATER CLOSET

[75] Inventor: Peter V. DeMarco, Dayton, N.J.

[73] Assignee: American Standard Inc., Piscataway, N.J.

[21] Appl. No.: 632,869

[22] Filed: Apr. 16, 1996

[51] Int. Cl.[6] ..... E03D 1/00

[52] U.S. Cl. ..... 4/415; 4/353; 251/209; 251/117

[58] Field of Search ..... 4/415, 353; 251/311, 251/309, 304, 286, 287, 209, 117, 285; 138/40, 44, 45, 46

[56] References Cited

U.S. PATENT DOCUMENTS

| | | | |
|---|---|---|---|
| 2,087,503 | 7/1937 | Clemmons | 137/111 |
| 2,183,677 | 12/1939 | Heath | 4/18 |
| 2,934,311 | 6/1960 | Sjoholm | 251/209 |
| 3,086,546 | 4/1963 | Brown | 137/436 |
| 3,542,338 | 11/1970 | Scaramucci | 251/209 |
| 4,145,775 | 3/1979 | Butler | 4/415 |
| 4,200,119 | 4/1980 | Cunningham | 251/117 |
| 4,764,996 | 8/1988 | Pino | 4/415 |
| 4,980,932 | 1/1991 | Stemples | 4/415 |
| 5,287,565 | 2/1994 | Auman et al. | 4/415 |

*Primary Examiner*—David J. Walczak

*Attorney, Agent, or Firm*—Ann M. Knab; Elaine Brenner Robinson

[57] ABSTRACT

An adjustable valve to control the amount of water flowing through the refill water hose to the overflow tube and into the water closet bowl. The valve is a dual component device including a housing structure and a lever component. Both the housing structure and lever component have a trunk section of similar shape, but of different size. The trunk section of the lever component fits snugly within the trunk section of the housing structure. The lever component is able to rotate within the housing structure. The trunk sections in both the housing structure and the lever component include openings which provide a passageway for water to flow therethrough. The openings in the housing structure are spherically shaped and the openings in the lever component are pear-shaped. The housing structure includes a pair of tabs disposed 90° from one another for limiting the rotation of the lever component such that the openings in both the housing structure and lever component are always aligned. As the lever component is rotated within the housing structure, the flow of water is varied. The water flow becomes more restricted as the lever component is rotated from one tab to the other, but is never completely obstructed.

12 Claims, 4 Drawing Sheets

WATER SAVING DEVICE FOR A WATER CLOSET

BACKGROUND OF THE INVENTION

The present invention is directed to a water saving device for use in a water closet and more particularly to a flow control valve device for use with the reseal tube in a water closet tank.

Water closets today are designed and manufactured to flush properly using approximately 1.6 gallons of water per flush (GPF). In meeting the 1.6 GPF requirement, it is important that little or no water is wasted during flushing. Water closets are provided with a holding tank in which a predetermined amount of water is accumulated after each use. In the course of this accumulation, part of the filling stream is diverted into the bowl itself, providing a liquid seal against gases and the like. This diversion of the filling stream is under the control of a ball cock mechanism or like means. More precisely, the ball cock mechanism itself splits into two flows, one directed into the holding tank and the other guided through a refill hose to an overflow tube and into the bowl.

Since water closets are manufactured of vitreous china and the dimensions may vary from piece to piece, refill water directed to the bowl through the refill hose may be more than enough to reseal the trapway of one water closet and not enough to reseal the trapway of another water closet. Additionally, the installation of each water closet is unique. Differences in water supply pressures, drain line piping, and the venting of the plumbing system all affect the performance of the water closet and the reseal water level. As much as 1200 ml of water can spill over the trap weir after the completion of the flush cycle. In many instances where water closets fail to satisfy the 1.6 GPF requirement, the bowl would have met the requirement if not for the excess refill water which spills over the weir after the completion of the flush cycle. This water does not enhance flush performance and is truly wasted. Therefore, to reduce water wastage, it is necessary to adjust each water closet after installation to compensate for vitreous china shrinkage, water supply pressures and drain line piping since such adjustments cannot be made at the manufacturing plant.

Attempts have been made to compensate for flush variations through the incorporation of valve devices in the refill line of the water closet tank. In U.S. Pat. No. 4,764,996 to Pino, a pinch clamp is provided on a water closet refill hose to adjust the amount of water flowing through the refill hose to the overflow tube. Moreover, U.S. Pat. No. 4,145,775 to Butler discloses the use of a rotary flow control valve which may be provided between the two cut ends of the refill hose. Butler describes rotating the opposing members of the valve to control the flow therethrough. U.S. Pat. No. 4,980,932 to Stemples provides what the patentee therein believes is an improved flow splitting valve over the Butler and Pino valves which includes separate lever handles for controlling flow to the water closet tank as well as to the refill hose. In each of these devices, the control of water flow has been affected by reducing the volume of the water stream which is directed into the overflow tube and continued to the water closet bowl. The refill hose carries water to the overflow tube as long as the valve on the refill hose remains open. Thus, as water flows into the water closet tank, refill water enters the overflow tube and refills the water closet bowl. By slowing the stream of water flowing from the refill hose to the overflow tube during the water closet refill cycle, less water is distributed into the overflow tube and hence to the water closet bowl itself.

Accordingly, all of the prior art valve devices used for controlling the flow of water through the refill hose are directed to valves which can be completely closed. Although the prior art devices allow for adjustment of the valve means, there is no means provided for preventing the valve from shutting off the water completely. If the flow of water is cut off by the valve, water is not directed to the reseal hose. The water closet bowl does not fill with water and a complete seal may not be provided. Hence, noxious fumes may enter the environment from the sewer system due to the absence of a proper water seal. Although, it may be possible to adjust the prior art valves to prevent a complete obstruction of water flow, there is no safeguard to prevent such an occurrence.

Thus, it is desirable to provide a valve device which controls the amount of water flowing through the refill hose but which does not allow the water to become completely blocked. It is important that a minimum flow of water to the bowl and trapway is maintained to effect the required seal in order to prevent noxious fumes from permeating through the water closet to the bathroom.

SUMMARY OF THE INVENTION

It is therefore an object of the invention to control the amount of water flowing into the water closet bowl.

It is a related object of the invention to ensure that a minimum flow of water reaches the bowl and trapway to effect the required seal.

These and other objects and advantages are achieved by the present invention which provides an adjustable valve to control the amount of water flowing through the refill water hose to the overflow tube and into the water closet bowl. The valve is a dual component device including a housing structure and a lever component. Both the housing structure and lever component have a trunk section of similar shape, but of different size. The trunk section of the lever component fits snugly within the trunk section of the housing structure. The lever component is able to rotate within the housing structure. The trunk sections in both the housing structure and the lever component include openings which provide a passageway for water to flow therethrough. The openings in the housing structure are circular and the openings in the lever component are pear-shaped. The housing structure includes a pair of tabs disposed 90° from one another for limiting the rotation of the lever component such that the openings in both the housing structure and lever component are always aligned. As the lever component is rotated within the housing structure, the flow of water is varied. The water flow becomes more restricted as the lever component is rotated from one tab to the other, but is never completely obstructed. Thus, a minimum flow of water is always guaranteed.

BRIEF DESCRIPTION OF THE DRAWINGS

The invention will be more fully appreciated from the following detailed description when the same is considered in connection with accompanying drawings in which.

DETAILED DESCRIPTION OF THE INVENTION

Figure 1:
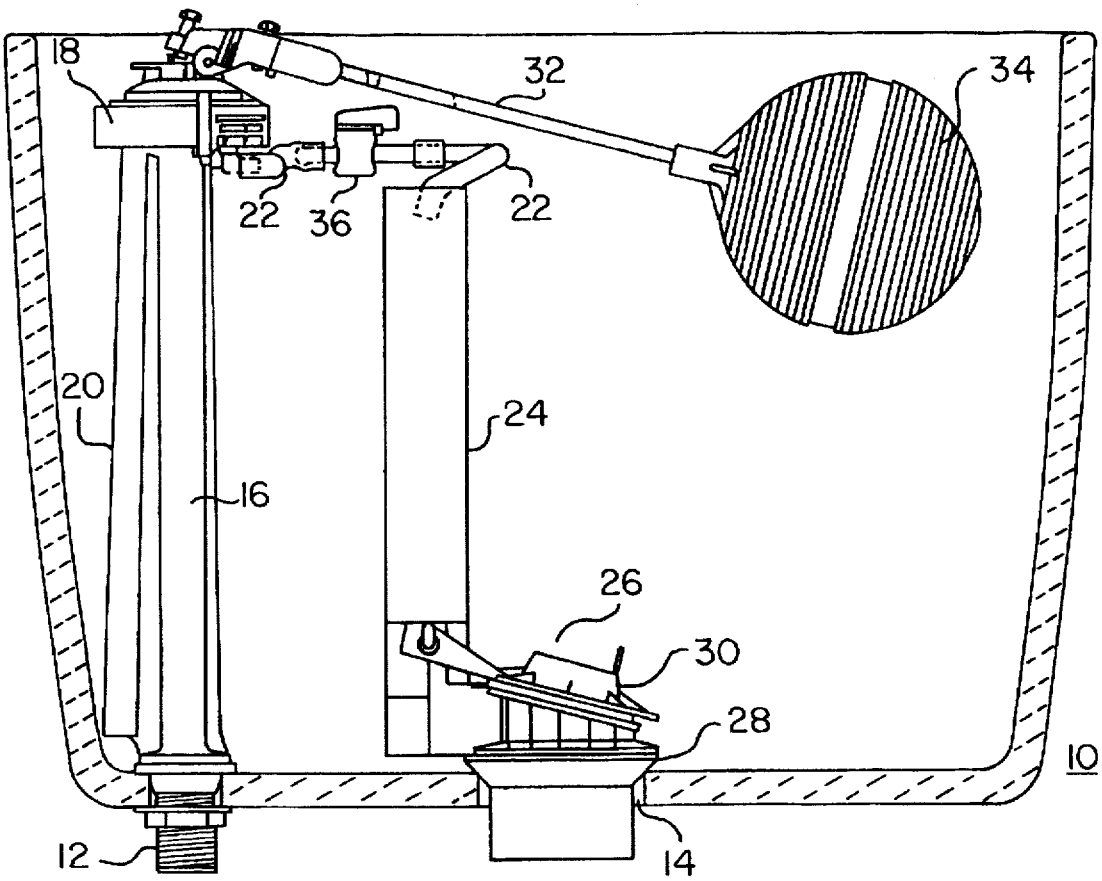
FIG. 1 is a front elevational view of a water closet tank showing the internal components therein including a valve constructed in accordance with the claimed invention.

Reference is now made to FIG. 1 which shows a conventional water closet tank 10 with flush components disposed therein. Tank 10 is provided with an inlet 12 extending through the bottom of the tank and adjacent to one side thereof, and with an outlet 14' extending through the bottom at a central position in the tank. A conduit 16 is connected to inlet 12 inside the tank, and is adapted to be connected to a pressurized water source. Conduit 16 is connected to a water control assembly 18. Water control assembly 18 is provided in the tank for refilling water closet tank 10 with fresh water after flushing has occurred. Water enters the tank through a water closet filling tube 20 which extends downwardly from water control assembly 18 with its open end spaced a short distance from the bottom of the tank. Some fresh water is also supplied to a reseal hose 22 during refilling of the tank. Reseal hose 22 directs water into an overflow tube 24 of a flush valve 26. Flush valve 26 includes a valve seat 28 and a pivotable flush valve flapper 30 which opens and closes the valve. Flush valve seat 28 is positioned in discharge outlet 14. Flapper 30 opens and closes during the flush cycle by means of a lift rod and chain (not shown) or other suitable means. Flush valve 26 serves to prevent the water from escaping downwardly through discharge outlet 14. A ball float 34 is connected to water control valve 18 via a float rod 32. When ball float 34 is in the upmost position supported by the full contents of the tank at the upper water lever as set via water control valve 18, water control 18 is in the off position. Water control 18 is switched to the on position when ball float 34 begins to lower as a reaction to the decrease in the water level in the tank.

The operation of the water closet involves the actuation of a trip lever (not shown) or like actuation means which is linked to flush valve 26. When the trip lever is actuated, flapper 30 is lifted off flush valve seat 28 and water is allowed to pass through outlet 14 into the water closet bowl. As the water level begins to decrease, ball float 34 begins to lower which in turn switches water control valve 18 to the on position. Water control valve 18 directs fresh water to both water closet filling tube 20 and reseal tube 22. In this way, water is provided to tank 10 and the water closet bowl to seal the trapway and prevent noxious gases from entering the water closet bowl. The standard water closet design typically allows too much refill water to pass into the water closet bowl during each refill operation so that unnecessary water wastage occurs.

In accordance with the instant invention, a flow control or reseal valve 36 is interposed in reseal hose 22. Valve 36 fits easily into hose 22 by merely cutting the tube and inserting valve 36 into the resulting ends of hose 22. Valve 36 may be fabricated of any suitable plastic material such as polypropylene. As particularly shown in FIGS. 2–5, flow control valve 36 comprises a housing structure 38 and a lever component 40. The body or trunk 42 of housing structure 38 is preferably barrel-shaped, although the specific shape is not limited hereto and other suitable shapes and forms may be used. Disposed on both the left and right sides of trunk section 42 are apertures 43 and 45. Extending from the left and right sides at apertures 43 and 45 of barrel section 42 are tubular stems 44 and 46. Reference is made to FIG. 4 which shows barrel section 42 having a closed bottom and an open top and a passageway 54 extending from tubular stem 44 through barrel section 42 at aperture 43 of housing structure 38 and continuing through aperture 45 to tubular stem 46. As shown in FIG. 3, barrel section 42 includes a pair of tabs 48 and 50 projecting longitudinally from the top edge thereof and a flange 52 projecting laterally from the top edge thereof and intermediate tabs 48 and 50. Flange 52 may include a series of characters, such as numbers, embossed thereon and arranged in chronological order. Reference is made to FIG. 3 which shows numbers 1 through 6 inscribed on flange 52. Preferably, tab 48 is positioned parallel to the axis of tubular stems 44 and 46 and tab 50 is positioned 90° from tab 48.

Figure 5:
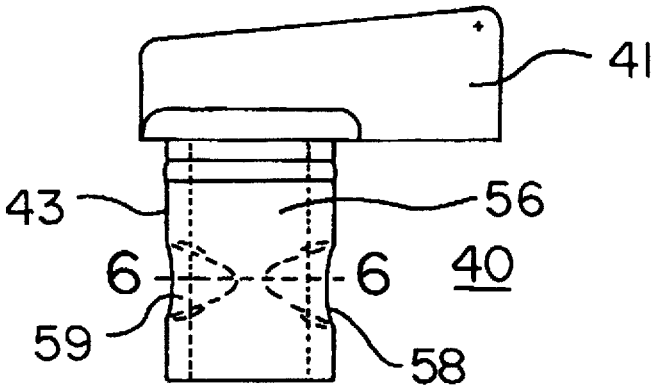
FIG. 5 is a front elevational view of the lever component of the valve in accordance with the claimed invention.
Figure 6:
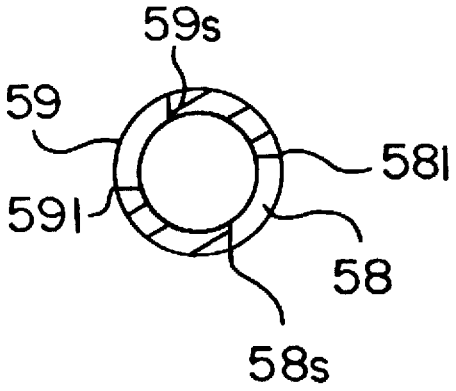
FIG. 6 is a sectional view of the trunk section of the lever component along line 6—6 in FIG. 5.

FIG. 5 shows lever component 40 having a closed top and an open bottom. The shape of the trunk or body section 43 of lever component 40 preferably imitates the shape of body section 42 of housing structure 38 except on a slightly smaller scale, such that body section 43 fits snugly within body section 42. A channel is denoted by the dotted lines at 56 in lever component 40. A pair of tapered slots 58 and 59 are disposed at the right and left sides, respectively, of trunk 43 of lever component 40. FIG. 6 clearly represents the location of slots 58 and 59 with respect to one another. The diameter of slot 58 is largest at the right side 58L of trunk 43 and smallest at the front side 58S of trunk 43. The diameter of slot 59 is largest at the left side 59L of trunk 43 and smallest at the rear side 59S of trunk 43. A handle 41 is disposed along the diameter of the closed top and preferably aligned parallel to the axes of sections 58L and 59L of slots 58 and 59.

Figure 2:
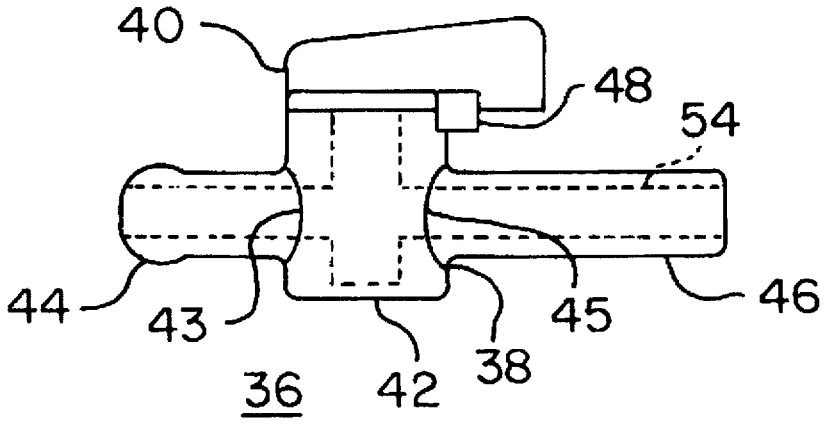
FIG. 2 is a front elevational view of the valve shown in FIG. 1.
Figure 3:
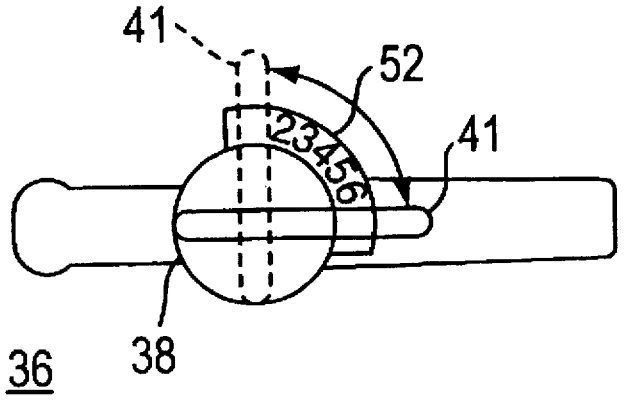
FIG. 3 is a top plan view of the valve shown in FIG. 2.
Figure 4:
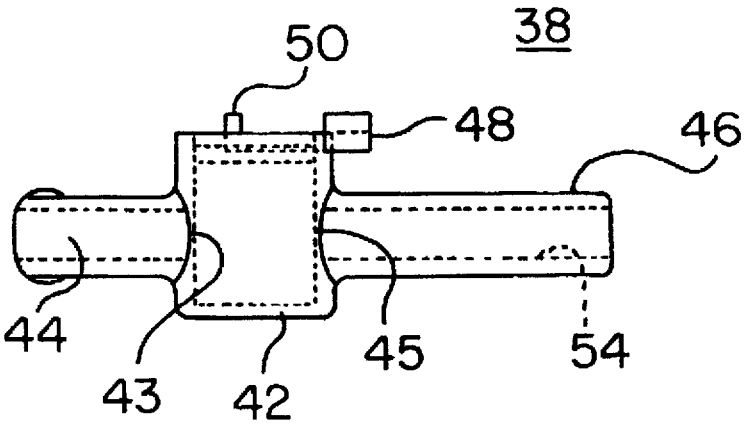
FIG. 4 is a front elevational view of the housing structure of the valve in accordance with the claimed invention.

After valve 36 is in place in reseal hose 22 as shown in FIG. 1, lever component 40 may be rotated within housing structure 38 between tabs 48 and 50 along flange 52 as shown in FIGS. 2 and 3. Water is able to flow through the first end of reseal hose 22 into tubular stem 44 into trunk 42, through slots 58 and 59 of lever component 40, through tubular stem 46 and through the second end of reseal hose 22. The flow of water is at its maximum velocity when lever handle 41 is at position 6. At position 6, the largest sections 58L and 59L of slots 58 and 59, as represented in FIG. 6, are aligned coaxially with apertures 43 and 45. As lever component 40 is rotated within housing structure 38 from tab 48 towards tab 50, the flow of water therethrough is progressively decreased. At position 1, sections 58S and 59S of slots 58 and 59 are aligned coaxially with apertures 43 and 45 and the water flow is at its minimum velocity. Accordingly, lever component 40 may be rotated to the point whereat the flow of water therethrough is the proper flow for refilling and sealing the water closet bowl.

The valve means is adjusted as follows. Flapper 30 is lifted to allow water to slowly flow into the bowl. The water level in the bowl will rise until it has reached the full trap seal depth. Flapper 30 is then released and the Water level in the bowl is marked. This line denotes the full trap seal depth. The water level in the tank is also checked to determine whether it is at the correct water level. This is determined by either a marked water line in the tank or instructions in the tank which disclose the appropriate distance below the overflow tube at which to set the water level. Reseal valve 36 is then adjusted. Normally, reseal valve 36 is set at the factory for a full, unrestricted flow. It can be set at 6 or more additional positions depending upon the number of positions available thereon which correspond to the increase in the amount of restriction to the flow of water directed into refill hose 22. To determine at which level the flow should be restricted, valve 36 is first set at a third or middle position. The trip lever is actuated and the water level in the bowl is checked to determine the time it reaches the line marked on the bowl. The goal is to have the water in the bowl reach the full trap seal depth line at approximately the same time as the water control 18 in the tank turns off. If the water in the bowl reaches the full trap seal depth line more than 5 seconds before the water control turns off, reseal valve 36 should be adjusted to apply increased restriction. The trip lever is then actuated and the water level in the bowl is measured to determine whether it has reached the full trap seal depth line. If the water level is not reached, the reseal valve device should be reset to decrease the restriction.

Although illustrative embodiments of the present invention have been described herein with reference to the accompanying drawings, it is to be understood that the invention is not limited to those precise embodiments, and that various other changes and modifications may be effected herein by one skilled in the art without departing from the scope or spirit of the invention.

What is claimed is:

1. In a water closet including a toilet bowl and a toilet tank for supplying fresh water to the bowl, wherein said tank has a flush assembly including a flexible tubular refill conduit for supplying water to the bowl after each flush, the improvement comprising:

an adjustable valve interposed on said refill conduit for controlling the amount of water to said bowl, said valve means including a housing structure and a lever component, said housing structure having a pair of apertures therein, said housing structure further including a pair of tabs thereon, said lever component housed in said housing structure, said lever component rotatable within said housing structure, said lever component having a pair of tapered slots therein and a lever handle thereon, the rotation of said lever component controlled by said lever handle, said lever handle limited in rotation by said tabs, the flow of water through said valve dependent on the position of said lever component within said housing structure and the tabs positioned such that the water flow can never be completely obstructed.

2. The adjustable valve of claim 1 wherein said housing structure includes a pair of tubular stems extending from said apertures.

3. The adjustable valve of claim 2 wherein a first tab is positioned parallel to the diameter of one of said apertures and a second tab is positioned 90° from said first tab.

4. The adjustable valve of claim 3 wherein said housing structure includes a flange intermediate said first tab and said second tab, said flange having a plurality of characters aligned along a length of said flange.

5. The adjustable valve of claim 4 wherein said characters are numbers arranged from highest to lowest in chronological order.

6. The adjustable valve of claim 5 wherein said lever handle may be positioned at any of said numbers.

7. The adjustable valve of claim 6 wherein said highest number is located at said first tab and said lowest number is located at said second tab.

8. The adjustable valve of claim 7 wherein water flow is least restricted when said lever handle is positioned at said highest number.

9. The adjustable valve of claim 8 wherein water flow is most restricted when the lever handle is positioned at said lowest number.

10. The adjustable valve of claim 9 wherein said numbers range from 1 through 6.

11. The adjustable valve of claim 10 being fabricated of a plastic material.

12. The adjustable valve of claim 11 wherein said plastic material is polypropylene.

* * * * *